United States Patent [19]

Globus

[11] 4,263,755

[45] Apr. 28, 1981

[54] ABRASIVE PRODUCT

[76] Inventor: Jack Globus, 585 Dorais St., Saint Laurent, Quebec H4M 1Z7, Canada

[21] Appl. No.: 84,065

[22] Filed: Oct. 12, 1979

[51] Int. Cl.[3] ..... B24D 17/00

[52] U.S. Cl. ..... 51/358; 51/295; 51/297; 51/406

[58] Field of Search ..... 51/295, 296, 298, 241 B, 51/241 S, 2 Y, 170 T, 358, 362, 365, 382, 383, 406, 407, 297

[56] References Cited

U.S. PATENT DOCUMENTS

| | | | |
|---|---|---|---|
| 2,780,533 | 2/1957 | Hurst | 51/298 |
| 2,996,368 | 8/1961 | Hermance | 51/293 |
| 3,030,251 | 4/1962 | Bore et al. | 51/295 |
| 3,136,614 | 6/1964 | Kuzmick | 51/298 |
| 3,288,579 | 11/1966 | Coates et al. | 51/295 |
| 3,401,490 | 9/1968 | Mora | 51/295 |
| 3,607,159 | 9/1971 | Haywood | 51/296 |
| 4,038,047 | 7/1977 | Haywood | 51/296 |
| 4,111,666 | 9/1978 | Kalbow | 51/295 |

*Primary Examiner*—Donald J. Arnold

*Attorney, Agent, or Firm*—Larson, Taylor & Hinds

[57] ABSTRACT

An abrasive sheet is disclosed which can be hand held or used with known abrasive devices, has longer abrasive life than existing abrasive sheets and has a novel attachment arrangement onto an abrasive support member. The abrasive sheet has abrasive material coated on one surface and a layer of resilient open-celled flexible foam on the other surface. The abrasive sheet may be used with a support member having a support surface with a multitude of fastening protuberances projecting from the support surface. The abrasive sheet is detachably fastened to the support member by pressing the layer of resilient open-celled foam against the support surface to have the protuberances enter and grip the open-celled foam.

6 Claims, 4 Drawing Figures

ABRASIVE PRODUCT

This invention relates to a new abrasive product. More particularly the invention describes an abrasive sheet with a novel backing that can be combined with abrasive devices.

Known abrasive devices employ an abrasive sheet detachably connected to a support member. Once the sheet becomes worn it is replaced. As an example, hand-held sanding blocks have an abrasive sheet such as sand paper, emery paper or emery cloth wrapped about a support surface on the block and detachably held by hand or clip on the block. Disc sanders employ a circular abrasive pad which in one embodiment is detachably attached to the support surfaces of a mounting disc by a nut and bolt connection. Both of the above abrasive devices have the disadvantage that a portion of the abrasive surface on the abrasive sheet or pad is non-usable. The wrap-around portions of the abrasive sheet on the sanding block are normally not used. Similarly, the area of the circular pad adjacent to the nut and bolt mounting to the disc is not used. Thus a portion of the abrasive sheet or pad is always wasted.

In other embodiments, there are provided coated abrasive pressure sensitive adhesive backed materials which are adhered to a pad or block. These products have other disadvantages in that the heat generated by friction causes the adhesive to adhere too strongly which causes the material to tear when it is removed and often leaves a film of adhesive on the pad or block, thereby requiring constant cleaning.

A further disadvantage in known abrasive devices such as the sanding block or disc sander is the time involved in replacing a worn abrasive sheet or pad with a new sheet or pad. In order to try to avoid slippage of the abrasive sheet or pad on the block or disc, the sheet or pad is tightly mounted on the support surface by clamping means or the nut and bolt connection. However, some slippage can still occur. More importantly, considerable time is required to release or remove the mounting means in order to change the sheet or pad.

Another disadvantage of known abrasive devices is that heat builds up during use in the support layer holding the abrasive material. The heat build-up reduces the effective life of the abrasive sheet or pad.

It is, therefore, the purpose of the present invention to provide an improved abrasive sheet which can be hand held or may be used with known abrasive devices. The improved abrasive sheet has longer abrasive life than existing abrasive sheets and has a novel attachment means onto an abrasive support member. It is another purpose to provide an improved abrasive sheet which can be mounted in a manner to provide a more useable abrasive area and which is less likely to slip when mounted.

In accordance with the present invention an abrasive sheet is provided having abrasive material coated on one surface and a layer of resilient, open-celled flexible foam on the other surface.

In a preferred embodiment the layer of resilient open-celled flexible foam is air-permeable, preferably polyurethane foam. This layer of resilient flexible foam is preferably adhesively secured to the other surface of the abrasive sheet.

The present invention also provides an abrasive device comprising a support member having a support surface, a multitude of fastening protuberances projecting from the support surface, an abrasive sheet having abrasive material coated on one surface and a layer of resilient, open-celled flexible foam on the other surface, the abrasive sheet detachably fastened to the support member by pressing the layer of resilient open-celled foam against the support surface to have the protuberances enter and grip the open-celled foam. The mounting provides excellent resistance to lateral slippage, while permitting quick and easy removal of the sheet for replacement. Since only the back surface of the sheet is used in mounting the sheet, the entire front abrasive surface area of the sheet is useable. No wrap-around abrasive areas or abrasive areas adjacent nut and bolt mountings are wasted. One advantage the present invention has over existing abrasive products, is the ability to be able to mount and remove the abrasive sheet on the support surface any number of times so that the sheet is not discarded before the abrasive properties are worn out. In comparison, for example, a coated abrasive pressure sensitive adhesive backed material is limited to the number of times it can be removed and replaced, and is often discarded before the abrasive properties are worn out.

Another important advantage in using a resilient, open-celled flexible foam layer on the abrasive sheet is that air is permitted to circulate between the abrasive sheet and the support member, thus helping dissipate heat from the abrasive material which is generated during sanding and thereby increasing the life of the abrasive sheet. This advantage is also apparent when the abrasive sheet is held in the hand, because the resilient open-celled flexible foam layer insulates the hand from the heat generated at the abrasive surface. In the past abrasive sheets were often folded over at least once to avoid this heat problem, which again resulted in a considerable wastage of abrasive sheet. Furthermore, the abrasive sheet of the present invention does not slip in the hand during use nearly as much as existing abrasive sheets having a smooth backing.

The resilient, open-celled flexible foam layer also provides for some flexibility in the mounted abrasive sheet which improves the sanding of contoured surfaces. In addition, the cushioning effect provided by the resilient layer makes it easier to sand sharp edges. The resilient layer considerably reduces the tendency of a folded abrasive sheet to crack at the fold. Cracks occurring at folds in a sheet tend to cause scratching during certain sanding operations.

It should be pointed out that apparently successful attempts have been made to mount abrasive elements on support members so as to minimize non-useable abrasive areas and to reduce mounting time. U.S. Pat. Nos. 3,522,681; 3,527,001 and 3,823,516 are exemplary of such mountings. None of these mountings, however, disclose the use of a layer of resilient open-celled flexible foam on the abrasive sheet or pad which layer gives the additional advantages set forth previously.

Fastener devices employing protuberances on one fastener element which cooperate with a foam layer on the other fastener element are known. One embodiment is shown in U.S. Pat. No. 3,708,833. It is not apparent, however, that such a fastener device could be incorporated in an abrasive device as disclosed herein.

U.S. Pat. No. 3,653,859 discloses an abrasive product having abrasive particles impregnated in a foam layer. However, this foam layer cannot be used to attach the product to a support member in an abrasive device. In addition, the foam layer must be dense so that it is doubtful that air circulation can take place through the foam.

The invention will now be described in detail having reference to the accompanying drawings in which.

Figure 1:
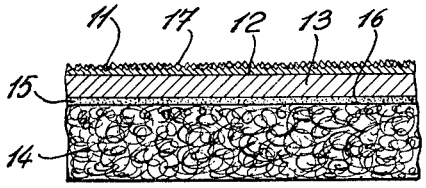
FIG. 1 is a partial cross-sectional view of the abrasive sheet of the present invention.

The abrasive sheet 10 of the present invention as shown in FIG. 1 has abrasive material 11 adhesively fastened on one surface 12 of a support sheet 13 of paper or cloth. A layer 14 of resilient open-celled flexible foam, preferably polyurethane foam, is attached with a suitable adhesive 15 to the opposite surface 16 of the support sheet 13.

The abrasive material 11 comprises known abrasive grains 17 such as sand, aluminum oxide, emery or silicon carbide by way of example. The support sheet 13 can be made from paper, cloth, fibre, or plastic material, and is well known in the abrasive art. The foam layer 14 must have an open-celled construction as opposed to closed-celled construction, so that air can circulate through the layer 14. The abrasive 15 fastening the foam layer 14 to the support sheet 13 is of the type which is heat resistant and flexible. By way of example, a resin based liquid abrasive or a water based liquid latex are both suitable adhesives.

Figure 2:
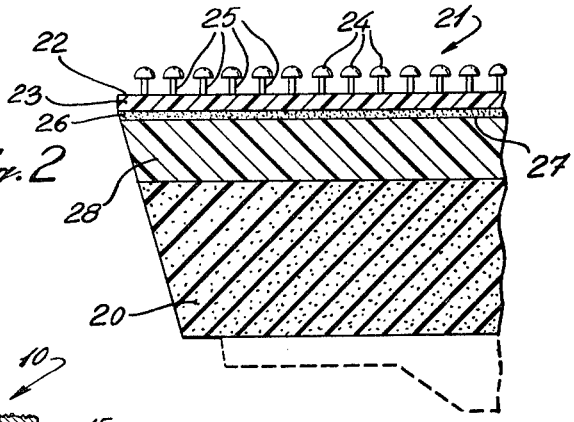
FIG. 2 is a partial cross-sectional view of a support member employed with the abrasive sheet of FIG. 1.
Figure 3:
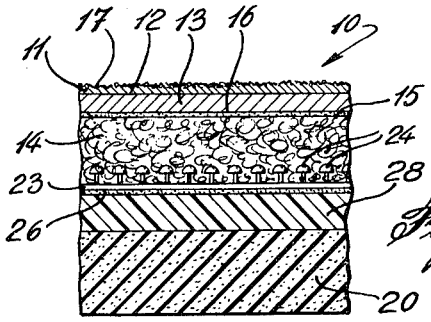
FIG. 3 is a partial cross-sectional view of the abrasive sheet shown in FIG. 1 mounted on the support member of FIG. 2.

The abrasive sheet 10 of the present invention may be hand held or may be employed with a support member 20 having a multitude of mounting protuberances 21 projecting from an outer mating surface 22 of the member 20. The mounting protuberances 21 cooperate with the foam layer 14 on the abrasive sheet 10 to detachably secure the abrasive sheet 10 to the support member 20. The mounting protuberances 21 project from the outer mating surface 22 which is on a backing sheet 23. The protuberances 21 are integral with the sheet 23 as shown in FIG. 2. Each mounting protuberance 21 preferably is of the type having an enlarged head portion 24 on the end of a slender stalk or stem portion 25 projecting from the backing sheet 23. A preferably commercial product having a multitude of such protuberances projecting from a sheet, is known as "Bell-touch", Kanebo Inc.'s trade mark for detachable and adjustable fabric fasteners. Other similar types of fastening systems are also adaptable for the present invention.

The backing sheet 23 is fastened by suitable adhesive 26 to one surface 27 on the support member 20 either directly, or indirectly through a resilient layer 28.

Figure 4:
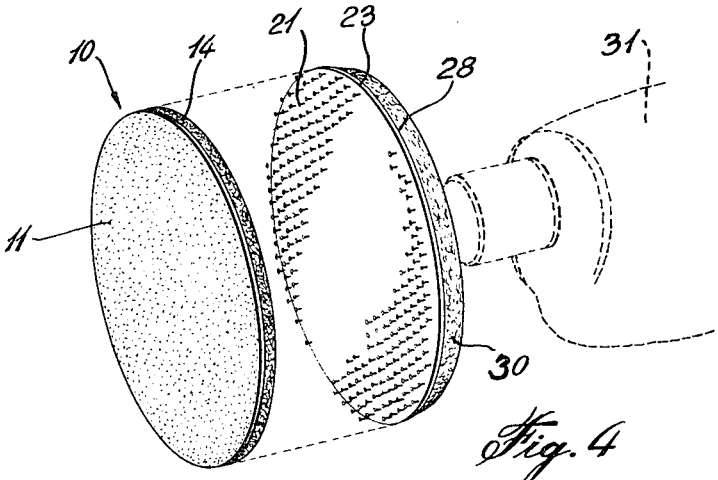
FIG. 4 shows a typical practical application of the abrasive sheet and the support member.

The support member 20 can comprise an ordinary sanding block, an orbital sanding disc, plasterers' pole sanders, vibrating sanders, mop sanders, or a circular sanding disc 30 as shown in FIG. 4. The sanding disc 30 has means for mounting it on a drill 31.

The present invention allows the abrasive sheet 10 to be quickly mounted on the support member 20 to form an abrasive device. The abrasive sheet 10 is merely pressed against the support member 20 with the foam layer 14 on the sheet facing the mounting protuberances 21 on the support member 20. The heads 24 on the mounting protuberances 21 pass into the open cells on the foam layer 14 to fasten the sheet 10 to the member 20. The assembled abrasive device has great resistance to shear separation yet the sheet can be easily pulled away from the support member to replace it when it becomes worn. An important feature of the present invention is the location of the open-celled foam layer 14 between the support sheet 13 carrying the abrasive material 11 and the mounting member 20. The open-celled foam layer 14 allows for air circulation behind the support sheet 13, thus reducing heat build-up in the support sheet 13 and the abrasive material 11, due to friction during sanding. The reduction in heat build-up increases the wear life of the abrasive sheet 10.

The embodiments of the invention in which an exclusive property or privilege is claimed are defined as follows:

1. An abrasive device comprising:

a support member having a support surface, a multitude of fastening protuberances projecting from the support surface, an abrasive sheet having abrasive material coated on one surface and a fastener layer of resilient open-celled flexible foam on the other surface, the abrasive sheet detachably fastened to the support member by pressing the layer of resilient open-celled foam against the support surface to have the protuberances enter and grip the open-celled foam.

2. The abrasive device as claimed in claim 1 wherein the fastening protuberances project from one surface of a backing sheet, the backing sheet adhesively fastened by its opposite surface to the support surface of the support member.

3. The abrasive device as claimed in claim 2 wherein each protuberance comprises an enlarged head at the end of a slender stem.

4. The abrasive device as claimed in claim 1 wherein the layer of resilient open-celled flexible foam is air permeable.

5. The abrasive device as claimed in claim 1 wherein the layer of resilient open-celled flexible foam comprises polyurethane foam.

6. The abrasive device as claimed in claim 5 wherein the multitude of fastening protuberances are stemmed hemispheres projecting from one surface of a backing sheet, the backing sheet adhesively fastened by its opposite surface to the support surface of the support member.

* * * * *